United States Patent [19]

Ida

[11] Patent Number: 4,918,419

[45] Date of Patent: Apr. 17, 1990

[54] IGNITION COIL FOR ENGINE

[75] Inventor: Yasuhiko Ida, Saitama, Japan

[73] Assignee: Honda Giken Kogyo Kabushiki Kaisha, Tokyo, Japan

[21] Appl. No.: 388,117

[22] Filed: Aug. 1, 1989

[30] Foreign Application Priority Data

Aug. 5, 1988 [JP] Japan ..... 63-103942[U]

[51] Int. Cl.[4] ..... H01F 15/10

[52] U.S. Cl. ..... 336/192; 336/96; 336/107; 336/178; 336/198; 439/877

[58] Field of Search ..... 123/634; 439/877, 881, 439/882; 336/192, 198, 208, 105, 107, 178, 96; 310/71

[56] References Cited

U.S. PATENT DOCUMENTS 3,513,453 5/1970 Fow ..... 439/877 X 4,166,265 8/1979 Reynolds ..... 336/192

*Primary Examiner*—Thomas J. Kozma

*Attorney, Agent, or Firm*—Lyon & Lyon

[57] ABSTRACT

There is disclosed an ignition coil for an engine which is arranged to connect a terminal end of a coil strand to a terminal member by pulling the terminal end of the coil strand out of a coil bobbin, positioning said terminal end of the coil strand in a U-shaped groove of a terminal member attached to the coil bobbin and then connecting the terminal end of the coil strand to said terminal member by fusing connection, while crushing the U-shaped groove of the terminal member, in which a guide member is provided on the coil bobbin to position the pulled out end of the coil strand at a predetermined position in the U-shaped groove of the terminal member.

1 Claim, 6 Drawing Sheets

IGNITION COIL FOR ENGINE

BACKGROUND OF THE INVENTION

1. Field of the Invention

The present invention relates to an ignition coil for an engine.

2. Description of the Prior Art

In case of an ignition coil for an engine, it has been a general practice to connect a terminal end of a coil strand at an end of a secondary coil to a terminal member for outside connection, by pulling the terminal end of the coil strand out of a coil bobbin, positioning said terminal end in a U-shaped groove of said terminal member and then electrically welding the coil strand (copper wire) positioned in the groove to the terminal member by applying heavy current to the groove from outside of the terminal member while crushing the groove of the terminal member. Such electrical welding connection is so-called as "fusing connection".

In such fusing connection, if the fusing connection is effected, while crushing a U-shaped groove 32 of a terminal member by an electric welding machine 34 in such state that a coil strand 33 is positioned on a bottom of the U-shaped groove, as shown in FIG. 7(*a*) and FIG. 7(*b*), a gap may be formed in the crushed part of the bottom of the U-shaped groove 32, that results in incomplete electric welding of the coil strand 33 passing such crushed part.

On the other hand, if the fusing connection is effected while crushing the U-shaped groove 32 in such state that the coil strand 33 passes through a shallow part in the U-shaped groove 32, as shown in FIG. 8(*a*) and FIG. 8(*b*), a complete connection cannot be attained.

In order to avoid such incomplete connection, it has been heretofor necessary to connect the coil strand to the terminal member, by manually positioning the coil strand 33 relatively to the U-shaped groove 32 so that the coil strand 33 passes through a center in the U-shaped groove 32 of the terminal member, as shown in FIG. 9(*a*) and FIG. 9(*b*), and then effecting the fusing connection while crushing the U-shaped groove 32.

SUMMARY OF THE INVENTION

It is a general object of the present invention to eliminate the above-mentioned defects in the prior arts.

It is a specific object of the present invention to provide an ignition coil for an engine which is arranged to connect a coil strand pulled out of a coil bobbin to a terminal member, by positioning a terminal end of the coil strand in a groove of the terminal member and connecting said terminal end to said groove by fusing connection while crushing the groove of the terminal member, in which the coil strand can be positioned at an optimum position in the groove of the terminal member.

In accordance with the present invention there is provided an ignition coil for an engine which is arranged to connect a terminal end of a coil strand to a terminal member by pulling the terminal end of the coil strand out of a coil bobbin, positioning said terminal end of the coil strand in U-shaped groove of a terminal member attached to the coil bobbin and then connecting the terminal end of the coil strand to said terminal member by fusing connection, while crushing the U-shaped groove of the terminal member, in which a guide member is provided on the coil bobbin to position the which was pulled out end of the coil strand at a predetermined position in the U-shaped groove of the terminal member.

BRIEF DESCRIPTION OF THE DRAWINGS

FIGS. 3(a), 3(*b*) and 3(*c*) are perspective views of a secondary coil bobbin part of the ignition coil of the same embodiment, showing successive steps of attaching a secondary coil output terminal member to the coil.

DESCRIPTION OF THE PREFERRED EMBODIMENT

Figure 1:
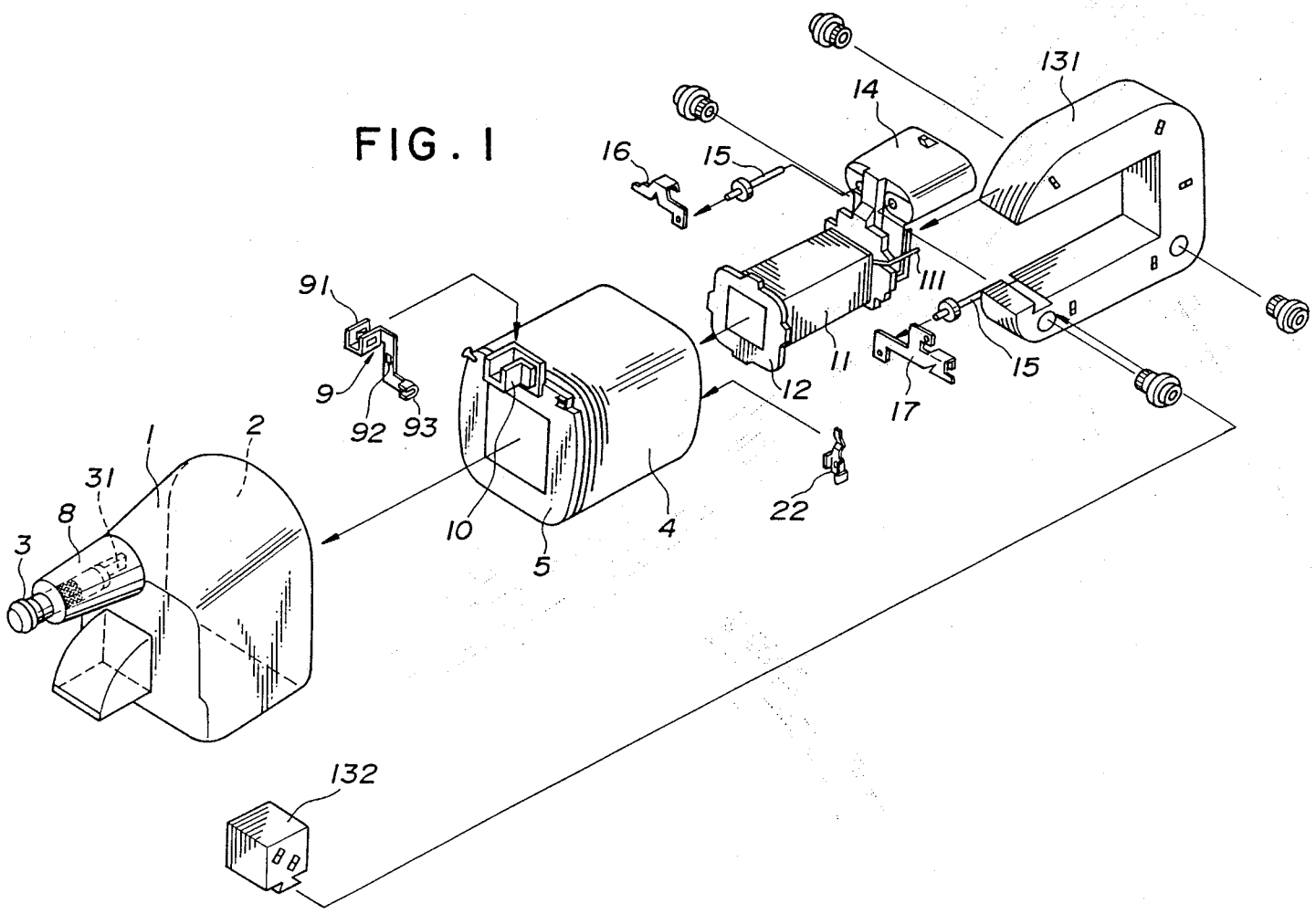
FIG. 1 is an exploded perspective view showing an ignition coil for an engine according to an embodiment of the present invention.

Now, descriptions will be given to a preferred embodiment of the invention, with reference to the drawings.

The ignition coil for the engine according to the present invention includes a coil unit consisting of a coil bobbin 5 having a secondary coil 4 wound therearound, a coil bobbin 12 having a primary coil 11 wound therearound and a magnetic core 131 and 132. The ignition coil further includes a coil case 1 having an opening end 2. Said coil unit is assembled into the coil case 1 and the part of the coil case 1 is molded by resinous material 23, so that they form a wholly fixed integral structure.

The coil unit is as constructed that the coil bobbin 12 at the primary side is inserted into a hollow shaft of the coil bobbin 5 at the secondary side and, furthermore, one side of the core 131 is inserted into a hollow shaft of the coil bobbin 12 at the primary side.

The coil case 1 has a hollow shaft (not shown) which is formed at the central part of the inside thereof and projects in integral relation with the case. The coil bobbin 12 of the primary side is fitted outside of said hollow shaft and the one side of the core 131 is fitted inside of said hollow shaft.

A high-voltage terminal pin 3 is inserted into a boss 8 at a side of the coil case 1 and fixed therein so that a plug portion 31 projecting rearwardly of the high-voltage terminal pin 3 projects into the inside of the coil case.

The coil bobbin 5 on which the secondary coil 4 is wound has a flange, and a secondary coil output terminal member 9 formed with an elastic socket portion 91 is attached to the flange of the coil bobbin 5 at a position confronting to the plug 31 of the high-voltage terminal pin 3. The terminal member 9 and the terminal pin 3 are so arranged that when the secondary side coil bobbin 5 is inserted into the coil case 1, the plug 31 of the high-voltage terminal pin 3 is inserted into the socket portion 91 of of the secondary coil output terminal member 9, whereby they are electrically connected together.

Figure 3:
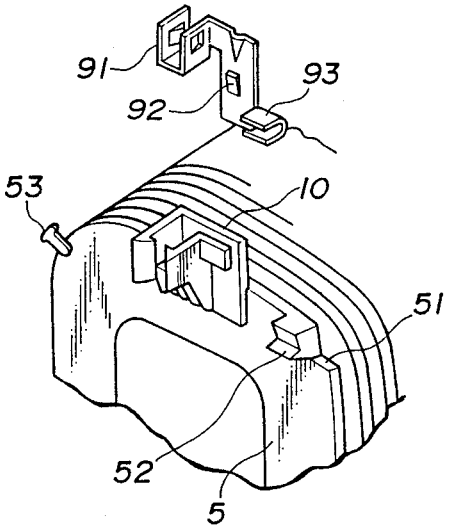
Figure 3:
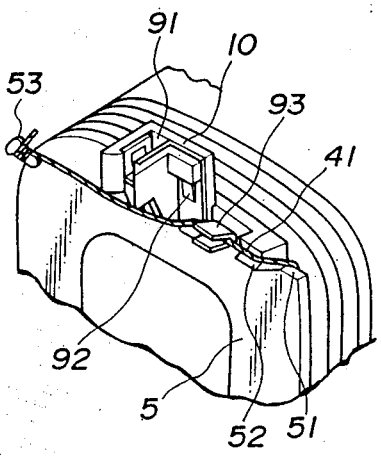
Figure 3:
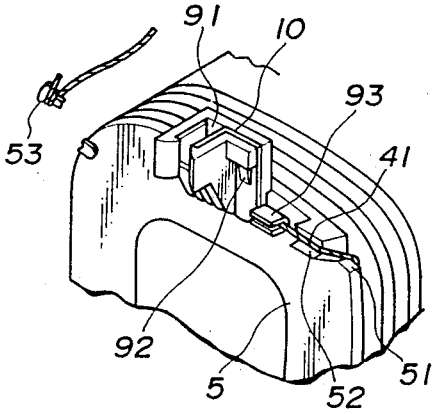

As shown in FIG. 3(*a*) and FIG. 3(*b*), the secondary coil output terminal member 9 is arranged to be inserted into a holder 10 formed on the flange at one end of the coil bobbin 5 and to be fixedly held in the holder 10 by engagement of a projecting piece 92 formed at the side of the terminal member 9 with a step portion formed at the side of the holder.

The second coil output terminal member 9 is integrally formed with a connecting portion 93, and a coil strand 41 at an end of the coil 4 wound around the coil bobbin 5 is pulled out of the coil bobbin 5 and connected to said connecting portion 93.

In the arrangement as described above, particularly in the arrangement according to the present invention, the terminal end of the coil strand 41 is pulled out of the coil bobbin 5 through a cut groove 51 formed in the flange of said coil bobbin and said terminal end of the coil strand is passed through a U-shaped groove formed on the connecting portion 93. The fusing connection is effected while the connecting portion 93 is crushed. A guide projection 52 is formed on the coil bobbin 5, in order to pass the terminal end of the coil strand 41 through the central part of the U-shaped groove.

Figure 4:
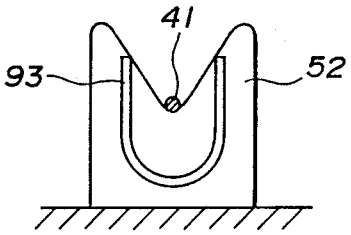
FIG. 4 shows an arrangement of a guide projection for a coil strand relation to a U-shaped groove of a terminal member.

The guide projection 52 is formed with a V-groove, as shown in FIG. 4, a bottom of said V-groove for guiding the coil strand 41 is arranged to be aligned with the central position of the U-shaped groove formed on the connecting portion 93 of the according coil output terminal member r9.

The coil strand 41 is connected with the connecting portion 93 in the manner as described hollow.

Firstly, the coil strand 41 pulled out of the coil bobbin 5 through the cut groove 51 formed in the flange portion of the coil bobbin 5 is guided by the guide projection 52 and is passed through the central position of the U-shaped groove formed on the connecting portion n93 of the secondary coil output terminal member 9, as shown in FIG. 3(*b*). The coil strand is wound around a projection 53 formed on the coil bobbin 5 to temporarily fix the terminal end of the coil strand.

Then, the fusing connection is effected, while crushing the connecting portion 93 of the secondary coil output terminal member 9, as shown in FIG. 3(*c*) and then useless portions of the secondary coil strand 41 are out and removed, together with the projection 53 of the coil bobbin 5.

Thus, according to the present invention, the coil strand 41 pulled out of the coil bobbin 5 is necessarily guided as that it passes through the center of the U-shaped groove formed on the connecting portion 93 of the secondary coil output terminal member 9, whereby the fusing connection can be effected always in optimum manner, without causing deterioration of the connection by crushing the connecting portion 93 and the work for effecting the fusing connection can be easily adapted to automatic process.

Furthermore according to the present invention, the fusing connection can be effected under the state where the coil strand 41 is temporarily fixed to the projections 53 and, therefore, the connecting work can be easily performed.

Figure 5:
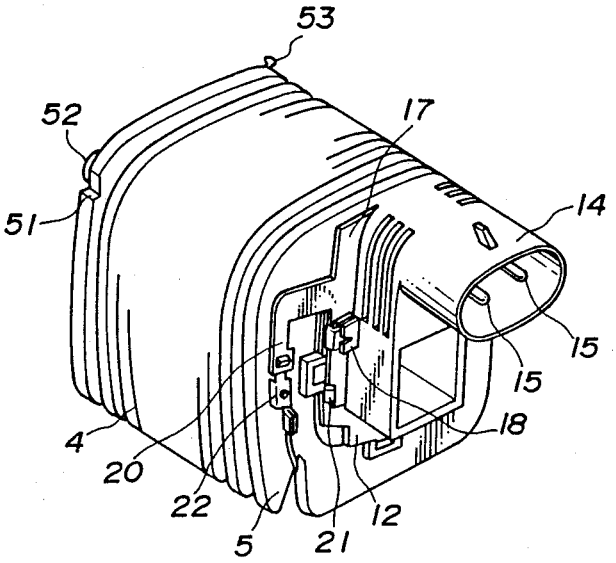
FIG. 5 is a perspective view showing a part of combination of a primary coil bobbin and a secondary coil bobbin.

The primary coil bobbin 12 has a low-voltage terminal coupler 14 which is formed on said primary coil bobbin, as shown in FIG. 5, and which is arranged to project outwardly when the primary coil bobbin 12 is combined into the secondary coil bobbin 5.

Figure 2:
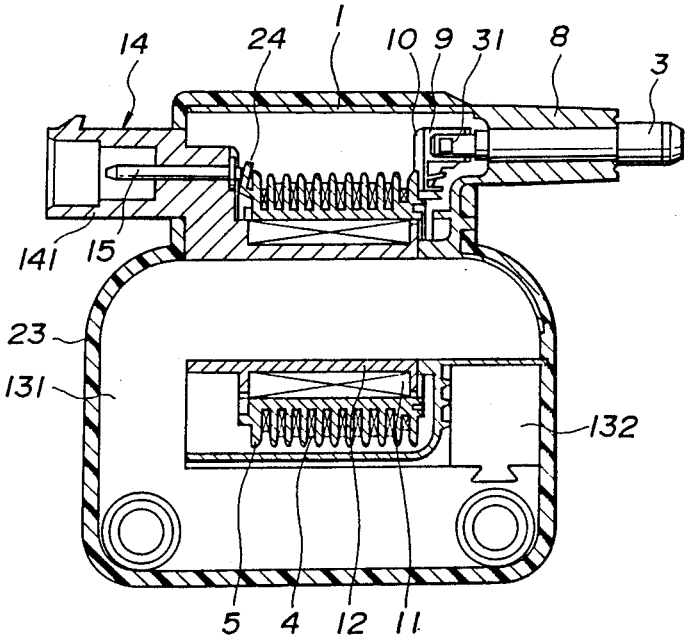
FIG. 2 is a sectioned view of the ignition coil shown in FIG. 1

The low-voltage terminal coupler 14 is so constructed that the terminal pins 15 having stoppers 151. respectively, are inserted through two holes 142 formed at a rear wall of a coupler case 141, as shown in FIG. 2. The terminal pin 15 is not always of a rod type but it may be of plate type.

As shown in FIG. 2, pin retainess 24 are arranged in the flange portion of the secondary coil bobbin 5 in opposite relation to the terminal pins 15 inserted in the coupler case 1, respectively, in order to retain the rear ends of the respective terminal pins 15, respectively, when the secondary coil bobbin 12 is assembled into the secondary coil bobbin 5, and to position the respective terminal pins 15 relatively to the coupler case 141.

The pin retainer 24 is formed integrally with the coil bobbin 5 and formed in U-shape so that the pin retainer has an elastic property.

In the construction as shown in FIG. 1, the respective terminal pins 15 mounted on the coupler case 141 and the coil strands 111 pulled out of the both ends of the primary coil 11 are connected with each other by means of connecting terminal members 16 and 17, respectively.

The respective terminal pins 15 and the coil strands 111 are connected by means of the connecting terminal members 16 and 17, in the manner as described below.

Figure 6:
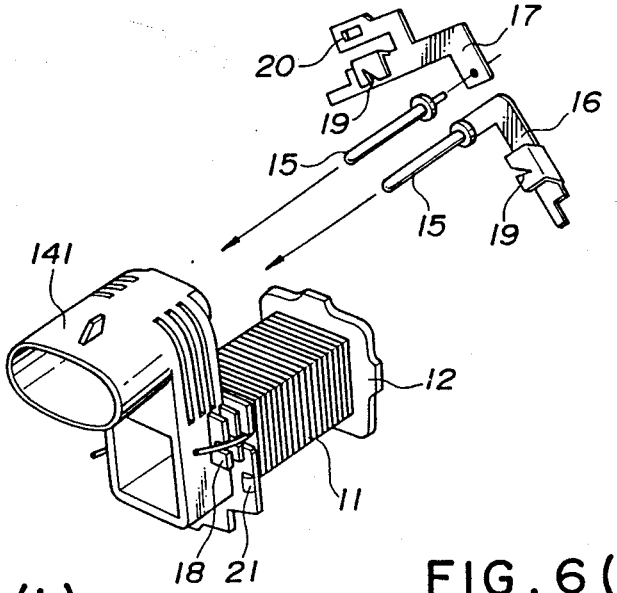
FIGS. 6(*a*), 6(*b*) and 6(*c*) are perspective views of the primary coil bobbin part, showing successive steps of connecting a lower-voltage terminal pin to a terminal end of the primary coil, in the above embodiment.
Figure 6:
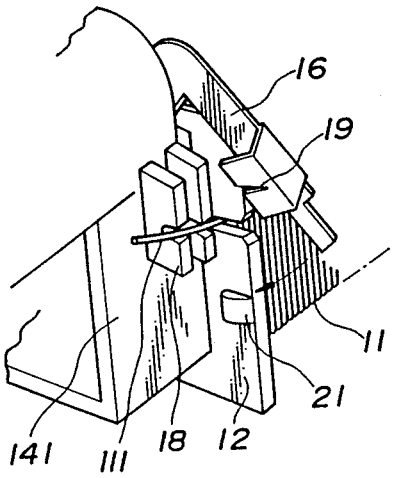
Figure 6:
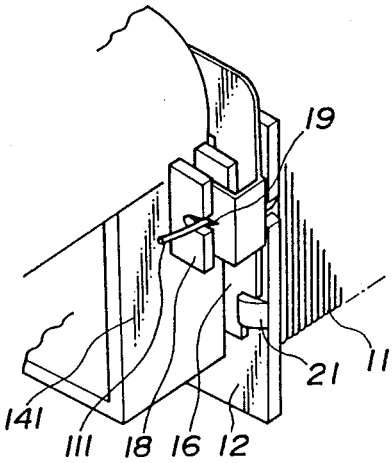
Figure 7:
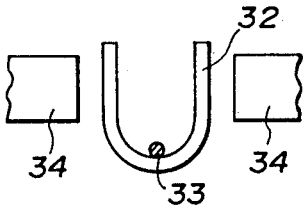
FIG. 7(*a*) shows a state where a coil strand is positioned an a bottom of a U-shaped groove of a terminal member and FIG. 7(*b*) shows a state where the fusing connection has been completed from the state shown in FIG. 7(*a*).
Figure 7:
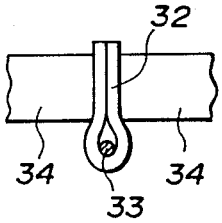
Figure 8:
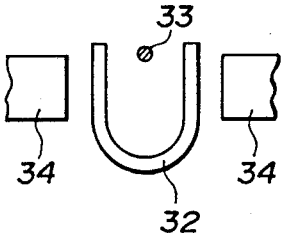
FIG. 8(*a*) shows a state where the coil strand is positioned at a shallow position in the U-shaped groove of the terminal member and FIG. 8(*b*) shows a state where the fusing connection has been completed from the state shown in FIG. 8(*a*).
Figure 8:
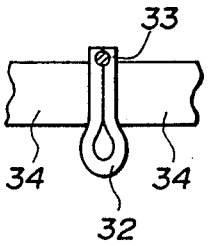
Figure 9:
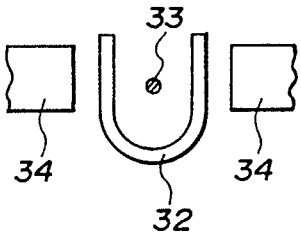
FIG. 9(*a*) shows a state where the coil strand is positioned at a center in the U-shaped groove of the terminal member and FIG. 9(*b*) shows a state where the fusing connection has been completed from the state shown in FIG. 9(*a*).
Figure 9:
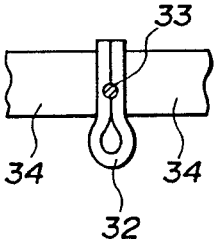

Firstly, the connecting terminal members 16 and 17 are attached to the ends of the respective terminal pins 15 by caulking (which provides electric connection between them), and the respective terminal pins 15 are mounted on the coupler case 141, as shown in FIG. 6(*a*).

Then, the connecting terminal member 16(17) is rotated, whereby the coil strand 111 held in the groove of the holder 18 of the coupler 14 is forcibly gripped by the cut groove 19 formed on the connecting terminal member 16 and 17, so that they are electrically connected together.

The cut groove 19 has a width which is slightly narrower then a diameter of the coil strand 11 at its inner side and said narrower side of said cut groove forcibly grips the coil strand 111, so that an insulating covering of the coil strand 111 is broken thereby and the electrical conduction is produced therebetween.

A stopped it is formed on the coil bobbin 12, and the forward end of the connecting terminal member 16(17), which has forcibly gripped the coil strand 111 at the cut groove 19, comes into engagement with the stopper 21, thereby locking the connecting terminal member 16(17).

The connecting terminal member 17 is integrally formed with a common connecting terminal portion 20 for common connection with the primary coil 11 and the secondary coil 4. This connection terminal portion 20 is arranged to come into contact with the coil terminal member 22 attached to the coil bobbin 5 when the primary coil bobbin 12 is assembled into the secondary coil bobbin 5. The parts thus contacted are connected together by soldering or electric welding.

The core of the ignition coil consists of the C-type core 131 and the small I-type core 132, and the core 132 is fitted in one end of the core 131 at the outside of the coil case 1, as shown in FIG. 2, thereby forming a closed magnetic circuit.

A case member of the coil case 1, which is made of a non-magnetic material and has a thickness of about 1 mm, is interposed between the forward end of the core 131 mounted in the coil case 1 and the core 132, thereby forming a magnetic gap, therebetween. Without such gap, the hysteresis caused by the core 131 and 132 is increased to such extent that the conversion efficiency of the coil is lowered and the ignition characteristic of the engine is determined.

Instead of using the construction in which the case member of the coil case 1 made of non-magnetic, material is interposed between the forward end of the core 131 mounted in the coil case 1 and the core 132, it is possible to use a construction in which the core 132 is fitted to the one end of the core 131 in such a manner that an air gap of about 1 mm is formed between the forward end of the core 131 and the core 132. Said air gap may be filled with resinous material at the time of molding.

As described above, the ignition coil for the engine according to the present invention is arranged to connect a terminal end of a coil strand to a terminal member by pulling the terminal end of te coil strand out of a coil bobbin, positioning said terminal end in a groove of a terminal member attached to the coil bobbin and then connecting the terminal end to said terminal member by fusing connection while crushing the groove of the terminal member, in which a guide member is provided to pass the terminal end of the coil strand through a predetermined position in the groove of the terminal member. Such construction of the ignition coil for the engine produces such superior technical advantage that the fusing connection while crushing the groove of the terminal member can be effected in optimum manner at any time.

I claim:

1. In an ignition coil for an engine wherein the ignition coil includes a bobbin, a coil on said bobbin, a terminal member having a groove in a portion thereof attached to said bobbin, and said coil having a terminal end positioned in said groove portion with the grooved portion being crushed onto a fused to said terminal end, the improvement comprising:

a guide member attached to said bobbin and positioning said terminal end of said coil above the bottom of said groove, said terminal end being attached to said grooved portion above the bottom of said groove.

* * * * *

UNITED STATES PATENT AND TRADEMARK OFFICE

CERTIFICATE OF CORRECTION

PATENT NO. : 4,918,419

DATED : April 17, 1990

INVENTOR(S) : Ida

It is certified that error appears in the above-identified patent and that said Letters Patent is hereby corrected as shown below:

Title page item [73]:

Please change "Honda Giken Kogyo Kabushiki Kaisha" as Assignee to -- Toyo Denso Kabushiki Kaisha --

Signed and Sealed this

Eighteenth Day of August, 1992

*Attest:*

DOUGLAS B. COMER

*Attesting Officer*

*Acting Commissioner of Patents and Trademarks*